US007753643B2

(12) United States Patent
Gonzalez et al.

(10) Patent No.: US 7,753,643 B2
(45) Date of Patent: Jul. 13, 2010

(54) STACKED LAMINATE BOLTED RING SEGMENT

(75) Inventors: Malberto F. Gonzalez, Orlando, FL (US); David C. Radonovich, Winter Park, FL (US); Anthony L. Schiavo, Oviedo, FL (US); Jay A. Morrison, Oviedo, FL (US); Steven J. Vance, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 930 days.

(21) Appl. No.: 11/526,256

(22) Filed: Sep. 22, 2006

(65) Prior Publication Data

US 2010/0150703 A1 Jun. 17, 2010

(51) Int. Cl.
*F01D 11/08* (2006.01)

(52) U.S. Cl. ..... 415/1; 415/173.4; 415/174.4

(58) Field of Classification Search ..... 415/173.1, 415/173.2, 173.4, 173.5, 173.6, 174.4, 213.1
See application file for complete search history.

(56) References Cited

U.S. PATENT DOCUMENTS

| | | | | |
|---|---|---|---|---|
| 4,218,276 | A | 8/1980 | King | |
| 4,786,343 | A | 11/1988 | Hertzberg | |
| 4,815,907 | A | 3/1989 | Williamson et al. | |
| 4,895,108 | A | 1/1990 | Caputo et al. | |
| 5,928,448 | A | 7/1999 | Daws | |
| 6,062,351 | A | 5/2000 | Strasser et al. | |
| 6,143,432 | A | 11/2000 | De Rochemont et al. | |
| 6,197,424 | B1 * | 3/2001 | Morrison et al. | 428/402 |
| 6,265,333 | B1 | 7/2001 | Dzenis et al. | |
| 6,397,603 | B1 | 6/2002 | Edmondson et al. | |
| 6,497,776 | B1 | 12/2002 | Butler et al. | |
| 7,247,003 | B2 * | 7/2007 | Burke et al. | 416/229 R |
| 7,534,086 | B2 * | 5/2009 | Mazzola et al. | 415/173.1 |
| 7,563,071 | B2 * | 7/2009 | Campbell et al. | 415/173.1 |
| 2003/0021628 | A1 | 1/2003 | Gudaitis et al. | |
| 2004/0005216 | A1 * | 1/2004 | Suzumura et al. | 415/173.3 |
| 2004/0047726 | A1 * | 3/2004 | Morrison | 415/116 |
| 2004/0062639 | A1 * | 4/2004 | Glynn et al. | 415/134 |
| 2005/0100726 | A1 | 5/2005 | Millard et al. | |
| 2005/0112321 | A1 | 5/2005 | Millard et al. | |
| 2006/0121265 | A1 * | 6/2006 | Thompson et al. | 428/293.4 |
| 2007/0020105 | A1 * | 1/2007 | Albrecht et al. | 416/224 |
| 2007/0140835 | A1 * | 6/2007 | Albrecht et al. | 415/115 |
| 2008/0107521 | A1 * | 5/2008 | Morrison et al. | 415/173.3 |
| 2008/0279678 | A1 * | 11/2008 | Merrill et al. | 415/173.4 |
| 2009/0010755 | A1 * | 1/2009 | Keller et al. | 415/197 |

FOREIGN PATENT DOCUMENTS

| | | | |
|---|---|---|---|
| WO | WO 87/05976 | A1 | 10/1987 |
| WO | WO 2005/044559 | A1 | 5/2005 |

* cited by examiner

*Primary Examiner*—Edward Look
*Assistant Examiner*—Aaron R Eastman

(57) ABSTRACT

A ceramic ring segment for a turbine engine that may be used as a replacement for one or more metal components. The ceramic ring segment may be formed from a plurality of ceramic plates, such as ceramic matrix composite plates, that are joined together using a strengthening mechanism to reinforce the ceramic plates while permitting the resulting ceramic article to be used as a replacement for components for turbine systems that are typically metal, thereby taking advantage of the properties provided by ceramic materials. The strengthening mechanism may include a bolt or a plurality of bolts designed to prevent delamination of the ceramic plates when in use by keeping the ceramic plates in compression.

16 Claims, 2 Drawing Sheets

STACKED LAMINATE BOLTED RING SEGMENT

FIELD OF THE INVENTION

This invention is directed generally to ceramic articles, and more particularly to ceramic ring segments that may be used in a turbine system as a replacement for metal components.

BACKGROUND OF THE INVENTION

Conventional gas turbine engines operate at high temperatures and therefore, many of the systems within the engine are formed from metals capable of withstanding the high temperature environments. For example, gas turbine systems often include ring segments that are stationary gas turbine components located between stationary vane segments at the tip of a rotating turbine blade or airfoil. Ring segments are exposed to high temperatures and high velocity combustion gases and are typically made from metal. While the metal is capable of withstanding the operating temperatures in earlier engines, the metal is often cooled to enhance the usable life of the ring segments. Many current ring segment designs use a metal ring segment attached either directly to a metal casing or support structure or attached to metal isolation rings that are attached to the metal casing or support structure. More recently, firing and/or operating temperatures of turbine systems have increased to improve engine performance. As a result, the ring segments have required more and more cooling to prevent overheating and premature failure. Even with thermal barrier coatings, active cooling is still necessary.

Ceramic materials, such as ceramic matrix composites, have higher temperature capabilities than metal alloys and therefore, do not require the same amount of cooling, resulting in a cooling air savings. Prior art ring segments made from CMC materials rely on shell-type structures with hooks or similar attachment features for carrying internal pressure loads. U.S. Pat. No. 6,113,349 and U.S. Pat. No. 6,315,519 illustrate ring segments with C-shaped hook attachments. Conventional ceramic matrix components are formed from layers of fibers positioned in planes and layers substantially parallel to the inner sealing surface of the ring segments. Out-of-plane attachment features, such as hooks or flanges, are formed by bending the laminae around a corner or radius. For cooled components, internal pressurization would load these attachment hooks in such a way as to cause high interlaminar tensile stresses. Other out-of-plane features common in laminated structures, such as T-joints, are also subject to high interlaminar stresses when loaded. One of the limitations of laminated ceramic matrix composite (CMC) materials, whether oxide or non-oxide based, is that their strength properties are not generally uniform in all directions (e.g. the interlaminar tensile strength is generally less than about 5% of the in-plane strength). Nonuniform fiber perform compaction in complex shapes and anisotropic shrinkage of matrix and fibers results in delamination defects in small radius corners and tightly curved sections, further reducing the already-low interlaminar properties. Load carrying capability in a direction normal to the fiber or laminate plane is still severely limited. Thus, a need exists for construction method for laminated ceramic composite materials which provides attachment features with high load carrying capability. Furthermore, a need exists for a ceramic article that has both improved load carrying attachment features and high structural integrity in a direction normal to the laminate plane. In addition, a need exists for a ceramic article that may be used as a replacement material for metal parts in turbine systems to improve the efficiencies of the turbine systems.

SUMMARY OF THE INVENTION

This present invention provides a ceramic article that may be used as a replacement for one or more metal components used in a turbine system. The ceramic article may include the use of one or more ceramic plates, such as ceramic matrix composite plates, that are reinforced using a strengthening mechanism located in the ceramic article to place the ceramic plates in compression. The strengthening mechanism may reinforce the ceramic plates to increase the strength of the assembled structure in the through thickness direction. The strengthening mechanism may be used within one or more locations of the ceramic article to provide reinforcement and/or improved interlaminar strength.

The ceramic article may be a ring segment for a turbine engine. The ring segment may be formed from a plurality of ceramic plates positioned such that side surfaces of the plates contact side surfaces of adjacent plates forming an inner sealing surface for turbine blade tips in a turbine engine. The plurality of ceramic plates may be coupled together with one or more strengthening mechanisms, wherein at least one strengthening mechanism may place the ceramic plates under compression in a direction generally orthogonal to the side surfaces of the plates and in a direction that is generally parallel to the inner sealing surface.

The plurality of ceramic plates may be coupled together with at least one strengthening mechanism extending through an orifice in each of the ceramic plates. The strengthening mechanism may comprise at least one bolt extending through the orifice in each of the ceramic plates and a releaseable connector tightened onto the bolt to place the plurality of ceramic plates in compression. Each of the plurality of ceramic plates may comprise a first orifice proximate to a first end of the ceramic plate and a second orifice proximate to a second end of the ceramic plate generally opposite to the first end, wherein the orifices in each of the plates may be aligned. The strengthening mechanism may comprise a first bolt extending through the first orifice in each of the ceramic plates and a releaseable connector tightened onto the first bolt to place the plurality of ceramic plates in compression and a second bolt extending through the second orifice in each of the ceramic plates and a releaseable connector tightened onto the second bolt to place the plurality of ceramic plates in compression. Each of the plurality of ceramic plates may include a first foot extending from a backside of the ceramic plate opposite to the inner sealing surface and at the first end, and a second foot extending from a backside of the ceramic plate opposite to the inner sealing surface and at the second end, wherein the first orifice is positioned in the first foot, and the second orifice is positioned in the second foot. The bolt may be composed of a material such as, but not limited to, a metal and a composite.

In another embodiment, the strengthening mechanism may comprise two compression plates. The first compression plate may have a first side engagement surface at a first end that extends in a first direction from the first compression plate for engaging a first outer side surface of one of the plurality of ceramic plates. The first compression plate includes a first coupling flange that extends in a second direction from the first compression plate that is generally opposite to the first direction and at a second end that is generally opposite to the first end. The second compression plate may have a second side engagement surface at a first end that extends in a first direction from the second compression plate for engaging a second outer side surface of one of the plurality of ceramic plates opposite to the first outer side surface. The second compression plate includes a second coupling flange that extends in a second direction from the second compression plate that is generally opposite to the first direction and at a second end that is generally opposite to the first end, and a releasable connector coupling the first and second compression plates together. The first compression plate may include one or more orifices in the first coupling flange, and the second compression plate may include at least one orifice in the second coupling flange aligned with the orifice in the first coupling flange. The releaseable connector may extend through the orifices in the first and second coupling flanges. In at least one embodiment, the releasable connector may be formed from a bolt and may include a spring on the bolt.

In one embodiment, the first compression plate may include two or more orifices in the first coupling flange, and the second compression plate may include two or more orifices in the second coupling flange aligned with the orifices in the first coupling flange. The releaseable connector may be formed from bolts that extend through the orifices in the first and second coupling flanges.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
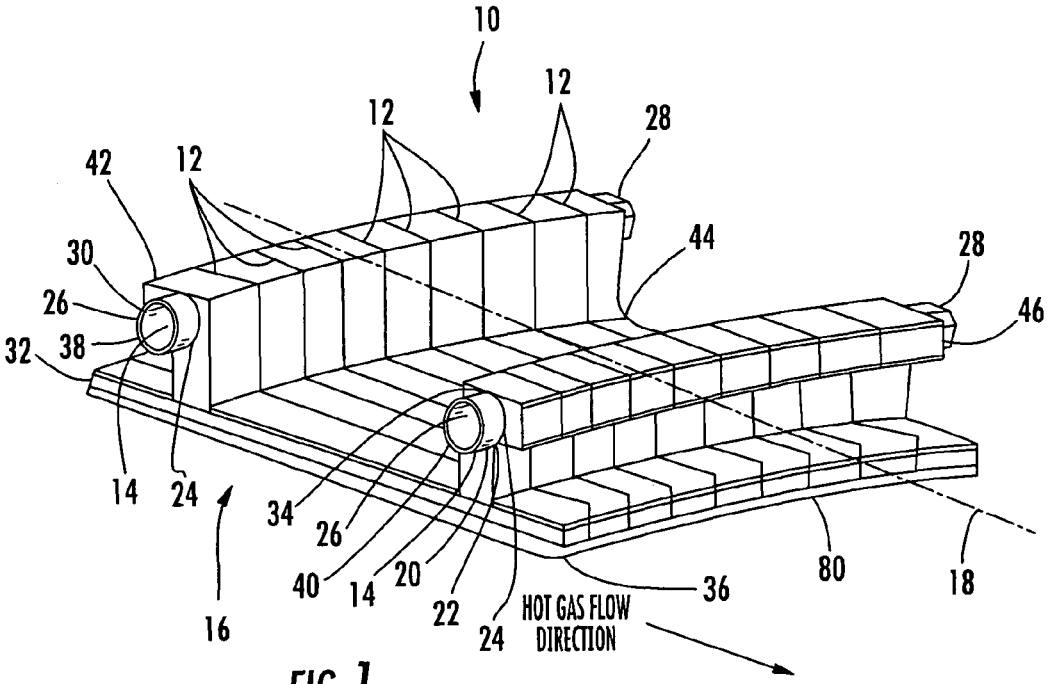
FIG. 1 is a perspective view of a reinforced ceramic ring segment having aspects of the present invention.
Figure 2:
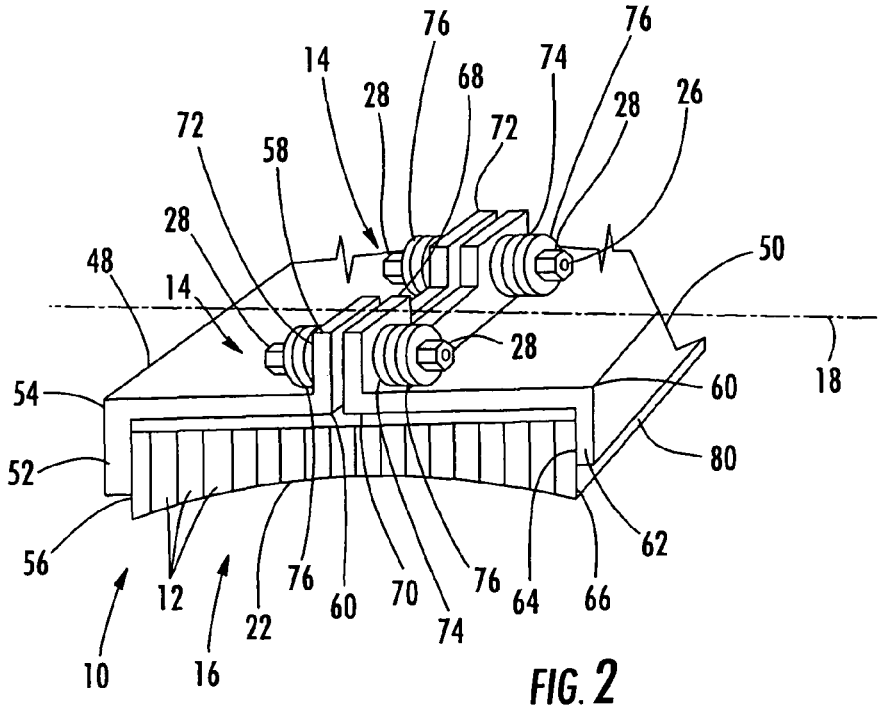
FIG. 2 is a perspective view of another embodiment of a reinforced ceramic ring segment having aspects of the present invention.
Figure 3:
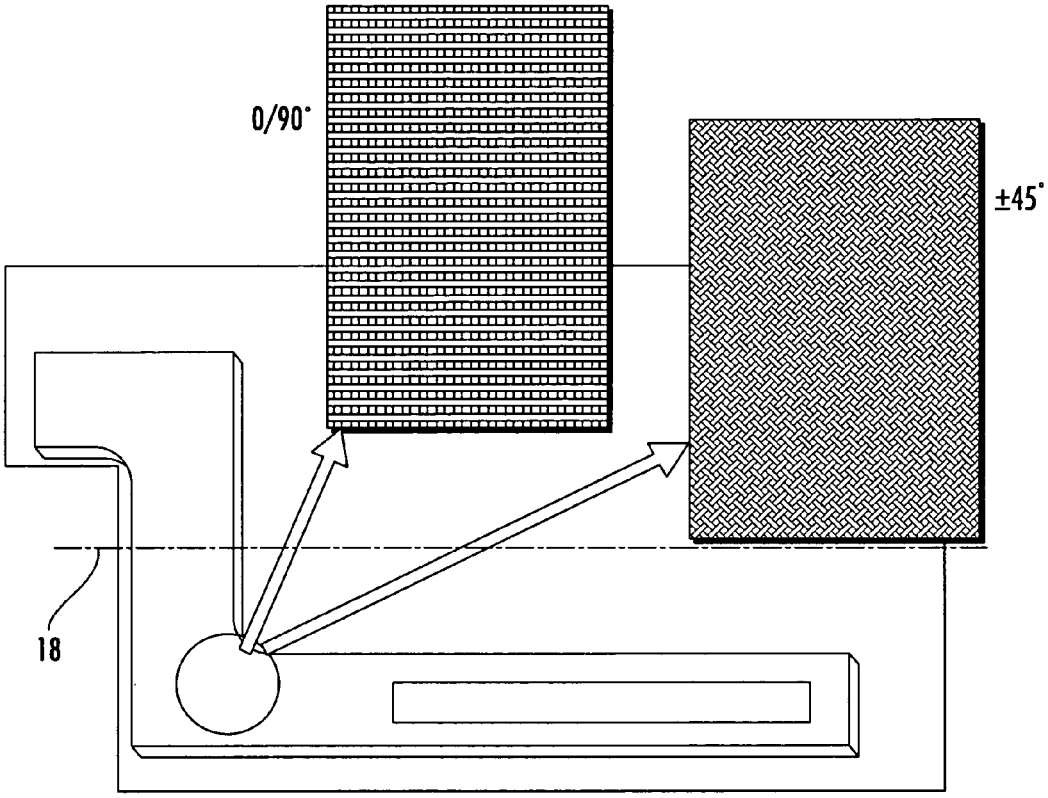
FIG. 3 is a cross-sectional view of a ceramic article having aspects of this invention.

As shown in FIGS. 1-3, the present invention is directed to a ceramic article 10 that may be used as a replacement for one or more metal components used in a turbine engine. The ceramic article 10 may be formed from CMC oriented unconventionally. In particular, the CMC may be positioned generally orthogonal to a inner sealing surface 22 such that the plane of reinforcing fibers is orthogonal to hot gas path. Such a configuration allows use of hooks and other attachment features where the loading is resisted by the CMC in the strongest direction of the CMC. In addition, the weak interlaminar bonds are oriented generally orthogonal to a inner sealing surface 22, which is the lowest load direction, and are reinforced as described below.

The ceramic articles 10 may include the use of one or more ceramic plates 12, such as ceramic matrix composite plates. In embodiments having a plurality of ceramic plates 12, the ceramic plates 12 may be positioned together and reinforced using a strengthening mechanism 14 selected to provide reinforcement to the ceramic plates 12 to increase the strength of the assembly of plates 12. The ceramic matrix composite plates 12 may be joined together or may be positioned together without being joined together. The strengthening mechanism 14 is selected such that it is located within one or more locations of the ceramic article. As such, the ceramic articles 12 may be used as a replacement for one or more parts in a turbine system that are typically metal, thereby enabling the greater temperature capacity of the ceramic materials to be utilized such that the efficiencies of the turbine systems may be increased relative to prior art systems.

Accordingly, in one aspect of the present invention, the ceramic article 10 includes a plurality of ceramic plates 12 that are joined together and then reinforced using a strengthening mechanism 14. By utilizing a plurality of ceramic plates 12, the ceramic plates 12 may be shaped as desired to form the selected shape of the final ceramic article 10. As such, the ceramic article 10 may be shaped to form parts that were, in the prior art, composed of metals or metal alloys, thereby taking advantage of the physical properties of the ceramic materials used to form the ceramic plates 12. In addition, the ceramic articles 10 are easier to manufacture in complex shapes than conventional CMC articles, may be more easily replicated, and/or may have more design flexibility than conventional CMC articles. It is to be understood that the ceramic articles of the present invention may be used to form other structures used in a gas turbine system or in any other system wherein the advantages of using a ceramic material over a metal material may be understood and recognized.

Laminated ceramic structures 10, while offering superior attributes to metal in two dimensions, generally have lower interlaminar strengths as compared to the properties of metal articles. The number, shape and thickness of the ceramic plates 12 used to form the ceramic articles 10 of the present invention may vary depending on one or more factors including, but not limited to, the ceramic article 10 to be formed, the ceramic material used to form the ceramic plates 12, the selected properties of the ceramic article 10 to be formed, the selected properties of the ceramic plates 12, the type of strengthening mechanism 14 to be used, or a combination thereof.

The ceramic articles 10 may be composed of one or more ceramic materials that are generally used in the formation of ceramic articles 12 and/or ceramic matrix materials. Examples of ceramic materials that may be used to form the ceramic articles 10 include, but are not limited to, cerium oxide, graphite, silicon, alumina, zirconia, glass, ferrites, silicon carbide, silicon nitride, sapphire, cordierite, mullite, magnesium oxide, zirconium oxide, boron carbide, aluminum oxide, tin oxide, cryolite powders, scandium oxide, hafnium oxide, yttrium oxide, spinel, garnet, lanthanum fluoride, calcium fluoride, boron nitride, steatite, lava, aluminum nitride, iron oxide, quartz, porcelain, forsterite or combinations thereof, as well as any other crystalline inorganic nonmetallic material or clay.

The ceramic articles 10 may include the use of a strengthening mechanism 14. The strengthening mechanism 14 is selected to increase the strength of the structure 10 formed by a plurality of ceramic plates 12. The strengthening mechanism 14 is selected to be placed within the ceramic article 10 to help reinforce the article 10 and/or prevent delamination of the ceramic plates 12 that compose the overall ceramic article 10. Therefore, the strengthening mechanism 10 serves to reinforce the stack of ceramic plates or segments normal to the plane of the plates 12 and/or to help inhibit separation of the ceramic plates 12. The number and location of the strengthening mechanisms 14 used may be optimized based upon one or more factors including, but not limited to, the local stresses to be applied to the ceramic article 10, the type of ceramic article 10, the type of strengthening mechanism 14 used, and/or the type of ceramic material used to form the ceramic article 10.

In one embodiment of the present invention, the ceramic article 10 is a gas turbine ring segment 16. In this embodiment, the ceramic plates 12 may be ceramic laminates formed from a ceramic matrix composite (CMC) material. The ceramic plates 12 may be formed and shaped such that the strong plane of the CMC material is oriented substantially perpendicular to the hot gas path surface of the ring segment 16, as shown in FIG. 3, and substantially parallel to the front-to-aft axis 18 of the ring segment 16. As such, the loads perpendicular to the hot gas path (i.e. differential pressure) may be carried in the strongest orientation of the laminated material of the ceramic plates 12. The CMC material, as shown in FIG. 3, may be formed from fibers in alternating layers of 0/90 degree orientation and plus/minus 45 degree orientation, formed from layers of 0/90 degree orientation or plus/minus 45 degree orientation. After the CMC laminates have been stacked and attached to each other, the final shape of the ring segment 16 may be formed, such as by cutting the ceramic material to a selected final shape. The cutting may be accomplished using any known procedures including, but not limited to, programmable laser methods or water jet methods.

The ring segment 16 may be formed from a plurality of ceramic plates 12 positioned such that side surfaces 20 of the plates 12 contact side surfaces 20 of adjacent plates 12 forming an inner sealing surface 22 for turbine blade tips in a turbine engine. The plurality of ceramic plates 12 may be coupled together with one or more strengthening mechanisms 14, wherein the strengthening mechanism 14 may place the ceramic plates 12 under compression in a direction generally orthogonal to the side surfaces 20 of the plates 12 and in a direction that is generally parallel to the inner sealing surface 22.

The plurality of ceramic plates 12 may be coupled together with at least one strengthening mechanism 14 extending through an orifice 24 in each of the ceramic plates 12 to increase the structural integrity and reduce the risk of delamination. The strengthening mechanism 14 may be a bolt 26 or a plurality of bolts 26 that may be placed within one or more locations of the ceramic article 10. The bolt 26 may be composed of a metal or a ceramic matrix composite material. The bolts 26 may be inserted into the ceramic article 10 in one or more locations to help reinforce the ceramic article. The bolts 26 may be inserted into the ceramic article 10 after formation of the ceramic article 10 or during formation of the ceramic article 10. The bolts 26 may have a substantially smooth surface, or may include one or more tabs or projections to help retain the bolt or bolts in place after being placed into the ceramic article 10.

In one embodiment, the plurality of ceramic plates 12 may be coupled together with at least one strengthening mechanism 14 extending through an orifice 24 in each of the ceramic plates 12 to increase the structural integrity and reduce the risk of delamination. The strengthening mechanism 14 may comprise at least one bolt 26 extending through the orifice 24 in each of the ceramic plates 12 and a releaseable connector 28 tightened onto the bolt 26 to place the plurality of ceramic plates 12 in compression. Each of the plurality of ceramic plates 12 may comprise a first orifice 30 proximate to a first end 32 of the ceramic plate 12 and a second orifice 34 proximate to a second end 36 of the ceramic plate 12 generally opposite to the first end 32, wherein the orifices 24 in each of the plates 12 may be aligned. The strengthening mechanism 14 may comprise a first bolt 38 extending through the first orifice 30 in each of the ceramic plates 12. A releaseable connector 28 may be tightened onto the first bolt 38 to place the plurality of ceramic plates 12 in compression, and a second bolt 40 may extend through the second orifice 34 in each of the ceramic plates 12 and a releaseable connector 28 may be tightened onto the second bolt 40 to place the plurality of ceramic plates 12 in compression. Each of the plurality of ceramic plates 12 may include a first foot 42 extending from a backside 44 of the ceramic plate 12 opposite to the inner sealing surface 22 and at the first end 32. A second foot 46 may extend from a backside of the ceramic plate 12 opposite to the inner sealing surface 22 and at the second end 36, wherein the first orifice 30 is positioned in the first foot 42, and the second orifice 34 is positioned in the second foot 46.

In another embodiment, as shown in FIG. 2, the strengthening mechanism 14 may comprise two compression plates 48, 50. The first compression plate 48 may have a first side engagement surface 52 at a first end 54 that extends in a first direction from the first compression plate 48 for engaging a first outer side surface 56 of one of the plurality of ceramic plates 12. The first compression plate 48 may include a first coupling flange 58 that extends in a second direction from the first compression plate 48 that is generally opposite to the first direction and at a second end 60 that is generally opposite to the first end 54. The second compression plate 50 may have a second side engagement surface 62 at a first end 64 that extends in a first direction from the second compression plate 50 for engaging a second outer side surface 66 of one of the plurality of ceramic plates 12 opposite to the first outer side surface 66. The second compression plate 50 may include a second coupling flange 68 that extends in a second direction from the second compression plate 50 that is generally opposite to the first direction and at a second end 70 that is generally opposite to the first end 64. A releasable connector 28 coupling the first and second compression plates 48, 50 together. The first compression plate 48 may include one or more orifices 72 in the first coupling flange 58, and the second compression plate 50 may include at least one orifice 74 in the second coupling flange 68 aligned with the orifice 72 in the first coupling flange 58. The releaseable connector 28 may extend through the orifices 72 in the first and second coupling flanges 58, 68. In at least one embodiment, the releasable connector 28 may be formed from a bolt 26. A biasing mechanism 76, such as a spring, may be attached to the bolt 26. Such biasing mechanisms 76 may be useful to account for differential thermal expansion between the compression plates, connectors, and ceramic plates, thus maintaining a desired load over a wider temperature range. Certain spring mechanisms such as Belleville washers are also useful for relieving bending in the connectors. This is also applicable to the embodiment shown in FIG. 1.

In one embodiment, the first compression plate 48 may include two or more orifices 72 in the first coupling flange 58, and the second compression plate 50 may include two or more orifices 74 in the second coupling flange 68 aligned with the orifices 72 in the first coupling flange 58. The releaseable connector 28 may be formed from bolts 26 that extend through the orifices 72, 74 in the first and second coupling flanges 58, 68. The strengthening mechanism 14 may be configured to impart a compressive preload to the ring segment 10, thus giving it greater tensile load carrying ability in the through-thickness direction. Such preload can be achieved by mechanical interlocking, bolting, CTE mismatch, shrink fitting, or any other method used in the industry. Alternately, the strengthening mechanism 14 may be configured to preferentially carry load. The mechanism may or may not include the use of bolts (for example, a metal frame shrink-fitted onto the CMC stack may provide adequate preload in some cases). As mentioned above, other mechanisms besides bolts or pins are also possible.

As shown in FIGS. 1 and 2, the ceramic article 10 may include an abradable and insulative coating 80 on the inner sealing surface 22. The abradable coating 80 may be any conventional or not yet developed abradable coating.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A ceramic article for a turbine engine, comprising:

at least one ceramic plate forming an inner sealing surface;

wherein the at least one ceramic plate is formed from a plurality of layers of fibers, wherein the layers are positioned generally orthogonal to the inner scaling surface;

wherein the ceramic article is a ring segment for a turbine engine and further comprising at least one strengthening mechanism attached to the at least one ceramic plate, wherein the at least one strengthening mechanism places the at least one ceramic plate under compression in a direction generally orthogonal to the side surfaces of the plates and in a direction that is generally parallel to the inner sealing surface;

wherein the at least one ceramic plate comprises a plurality of ceramic plates;

wherein the plurality of ceramic plates are coupled together with at least one strengthening mechanism extending through an orifice in each of the ceramic plates.

2. The ceramic article of claim 1, wherein the strengthening mechanism comprises at least one bolt extending through the orifice in each of the ceramic plates and a releasable connector tightened onto the bolt to place the plurality of ceramic plates in compression.

3. The ceramic article of claim 2, wherein each of the plurality of ceramic plates comprises a first orifice proximate to a first end of the ceramic plate and a second orifice proximate to a second end of the ceramic plate generally opposite to the first end, wherein the orifices in each of the plates may be aligned, and wherein the at least one strengthening mechanism comprises a first bolt extending through the first orifice in each of the ceramic plates and a releasable connector tightened onto the first bolt to place the plurality of ceramic plates in compression and a second bolt extending through the second orifice in each of the ceramic plates and a releasable connector tightened onto the second bolt to place the plurality of ceramic plates in compression.

4. The ceramic article of claim 3, wherein each of the plurality of ceramic plates includes a first foot extending from a backside of the ceramic plate opposite to the inner sealing surface and at the first end, and a second foot extending from a backside of the ceramic plate opposite to the inner sealing surface and at the second end, wherein the first orifice is positioned in the first foot, and the second orifice is positioned in the second foot.

5. The ceramic article of claim 1, wherein the strengthening mechanism comprises two compression plates, wherein a first compression plate has a first side engagement surface at a first end that extends in a first direction from the first compression plate for engaging a first outer side surface of one of the plurality of ceramic plates and a first coupling flange that extends in a second direction from the first compression plate that is generally opposite to the first direction and at a second end that is generally opposite to the first end, and a second compression plate has a second side engagement surface at a first end that extends in a first direction from the second compression plate for engaging a second outer side surface of one of the plurality of ceramic plates opposite to the first outer side surface and a second coupling flange that extends in a second direction from the second compression plate that is generally opposite to the first direction and at a second end that is generally opposite to the first end, and a releasable connector coupling the first and second compression plates together.

6. The ceramic article of claim 5, wherein the first compression plate includes at least one orifice in the first coupling flange and the second compression plate includes at least one orifice in the second coupling flange aligned with the at least one orifice in the first coupling flange, and wherein the releasable connector extends through the at least one orifice in the first and second coupling flanges.

7. The ceramic article of claim 6, wherein the releasable connector comprises a bolt, and further comprising at least one spring on the bolt.

8. The ceramic article of claim 5, wherein the first compression plate includes at least two orifices in the first coupling flange and the second compression plate includes at least two orifices in the second coupling flange aligned with the at least two orifices in the first coupling flange, and wherein the releasable connector comprises bolts extending through the orifices in the first and second coupling flanges.

9. The ceramic article of claim 1, further comprising an abradable coating on the inner sealing surface.

10. A ring segment for a turbine engine, comprising:

a plurality of ceramic plates positioned such that side surfaces of the plates contact side surfaces of adjacent plates forming an inner sealing surface for turbine blade tips in a turbine engine;

wherein each of the plurality of ceramic plates includes a first foot extending from a backside of the ceramic plate opposite to the inner sealing surface and at the first end, and a second foot extending from a backside of the ceramic plate opposite to the inner sealing surface and at the second end;

wherein each of the plurality of ceramic plates comprises a first orifice proximate to a first end of the ceramic plate in the first foot and a second orifice proximate to a second end of the ceramic plate generally opposite to the first end in the second foot;

wherein the orifices in each of the plates may be aligned; and at least one strengthening mechanism comprising a first bolt extending through the first orifice in each of the ceramic plates and a releasable connector tightened onto the first bolt to place the plurality of ceramic plates in compression and a second bolt extending through the second orifice in each of the ceramic plates and a releasable connector tightened onto the second bolt to place the plurality of ceramic plates in compression in a direction generally orthogonal to the side surfaces of the plates and in a direction that is generally parallel to the inner sealing surface.

11. The ring segment of claim 10, further comprising an abradable coating on the inner sealing surface.

12. A method of forming a ring segment for a turbine engine, comprising:

attaching side surfaces of a plurality of ceramic plates together to form the ring segment with an inner sealing surface for turbine blade tips, wherein each of the plurality of ceramic plates includes at least one orifice such that when the ceramic plates are attached together, the orifices align to form a channel; and inserting at least one strengthening mechanism through the orifices in the plurality of ceramic plates and attaching a releasable connector tightened onto the bolt to place the ceramic plates under compression in a direction generally orthogonal to the side surfaces of the plates and in a direction that is generally parallel to the inner sealing surface.

13. The method of claim 12, wherein inserting at least one strengthening mechanism further comprises each of the plurality of ceramic plates includes a first orifice proximate to a first end of the ceramic plate and a second orifice proximate to a second end of the ceramic plate generally opposite to the first end, wherein the orifices in each of the plates may be aligned, and wherein the at least one strengthening mechanism comprises a first bolt extending through the first orifice in each of the ceramic plates and a releasable connector tightened onto the first bolt to place the plurality of ceramic plates in compression and a second bolt extending through the second orifice in each of the ceramic plates and a releasable connector tightened onto the second bolt to place the plurality of ceramic plates in compression.

14. The method of claim 12, wherein inserting at least one strengthening mechanism further comprises each of the plurality of ceramic plates including a first foot extending from a backside of the ceramic plate opposite to the inner scaling surface and at the first end, and a second foot extending from a backside of the ceramic plate opposite to the inner sealing surface and at the second end, wherein the first orifice is positioned in the first foot, and the second orifice is positioned in the second foot.

15. The method of claim 12, wherein inserting at least one strengthening mechanism further comprises at least one bolt composed of a material selected from the group consisting of a metal and a composite.

16. The method of claim 12, further comprising attaching an abradable coating on the inner sealing surface.

* * * * *